United States Patent [19]

Dietrich

[11] 4,228,942

[45] Oct. 21, 1980

[54] METHOD OF PRODUCING ABRASIVE COMPACTS

[76] Inventor: Rainer Dietrich, 5 Mooregrove, Kibler Park, Johannesburg, Transvall, South Africa

[21] Appl. No.: 911,107

[22] Filed: May 31, 1978

[30] Foreign Application Priority Data

Jun. 24, 1977 [ZA] South Africa ..... 77/3813

[51] Int. Cl.[3] ..... B23K 1/04; B24D 3/06

[52] U.S. Cl. ..... 228/121; 51/309

[58] Field of Search ..... 228/121, 122, 124; 51/309 R

[56] References Cited

U.S. PATENT DOCUMENTS 2,137,201 11/1938 Boyer ..... 51/309 R X 2,778,651 12/1955 Hall ..... 51/309 R X

FOREIGN PATENT DOCUMENTS 650637 10/1962 Canada ..... 228/124

1489130 10/1977 United Kingdom ..... 51/309 R

*Primary Examiner*—Francis S. Husar

*Assistant Examiner*—K. J. Ramsey

*Attorney, Agent, or Firm*—Young & Thompson

[57] ABSTRACT

A method of bonding a diamond or cubic boron nitride abrasive compact to a second such compact in which a braze alloy layer is deposited on a layer of a transition metal on the first compact, the second compact being then placed on the braze layer and the whole assembly being heated to effect bonding between the first and second compacts.

16 Claims, No Drawings

METHOD OF PRODUCING ABRASIVE COMPACTS

BACKGROUND OF THE INVENTION

This invention relates to abrasive bodies, and more particularly to abrasive bodies which contain abrasive compacts.

Abrasive compacts are well known in the art and consist essentially of a mass of abrasive particles, generally present in an amount of at least 70%, preferably 80 to 90%, by volume of the compact, bonded into a hard conglomerate. Compacts are polycrystalline masses and can replace single large crystals. The abrasive particles of compacts are invariably superhard abrasives such as diamond and cubic boron nitride.

Abrasive compacts, particularly diamond and cubic boron nitride compacts, may be self bonded, i.e. the individual particles of the compact may be fused and bonded together without the aid of a metal or like bonding matrix. Alternatively, stronger and more durable compacts are produced when there is a suitable bonding matrix present.

In the case of cubic boron nitride compacts, i.e. compacts in which the abrasive particle is predominantly cubic boron nitride, the bonding matrix, when provided, preferably contains a catalyst (also known as a solvent) for cubic boron nitride growth such as aluminium or an alloy of aluminium with nickel, cobalt, iron, manganese or chromium. Such catalysts tend to be soft and to minimise smearing of the catalyst during use of the compact it is preferred that the matrix also includes a ceramic such as silicon nitride which is capable of reacting with the catalyst to produce a hard material.

In the case of diamond compacts, i.e. compacts in which the abrasive particle is predominantly diamond, the bonding matrix, when provided, preferably contains a solvent for diamond growth. Suitable solvents are metals of Group VIII of the Periodic Table such as cobalt, nickel or iron or an alloy containing such a metal.

For diamond and cubic boron nitride compacts the presence of a solvent or catalyst for the particular abrasive being used in the compact is desirable because then under the conditions necessary for the manufacture of such compacts intergrowth between the particles occurs. As is known in the art, diamond and cubic boron nitride compacts are generally manufactured under conditions of temperature and pressure at which the abrasive particle is crystallographically stable.

Diamond and cubic boron nitride compacts are used for the machining of metals and natural rock. In use, the compacts are bonded to a suitable support such as a shank to form a tool.

The compacts may be bonded to a backing such as a cemented carbide backing and then the backing bonded to the support to form the tool. Diamond and cubic boron nitride compacts bonded to a cemented tungsten carbide backing are described and illustrated in British Patent specifications Nos. 1,349,385, 1,407,393 and 1,489,130.

This invention is concerned with bonding a diamond or cubic boron nitride abrasive compact to another such compact or to a cemented carbide backing by means of an alloy bonding layer of a type similar to that described and claimed in British Patent specification No. 1,489,130.

SUMMARY OF THE INVENTION

According to the invention there is provided a method of bonding a diamond or cubic boron nitride abrasive compact to a second such compact or to a cemented carbide support including the steps of depositing a layer of a transition metal on the first compact, depositing a layer of a braze alloy on the transition layer, the braze alloy having a melting point in the range 650° C. to 750° C. and being capable of alloying with the transition metal, placing the second compact or carbide support on the braze layer and heating the whole at a temperature between 650° C. and 750° C. to effect bonding between the first compact and the second compact or carbide support.

This method provides a very effective way in which a diamond or cubic boron nitride compact may be bonded to another compact or, more particularly, to a cemented carbide support. The bonding is effective because it takes place at a relatively low temperature yet produces an alloy bonding layer which has a relatively high melting point. The transition metal which alloys with the braze layer tends to increase the melting point of that braze. This is of particular importance for diamond compacts where graphitisation takes place readily at temperatures in excess of 750° C.

DESCRIPTION OF THE PREFERRED EMBODIMENTS

The transition metal layer will generally be discontinuous, although it need not be. Discontinuous transition metal layers may be provided by powdered transition metals. When a powdered transition metal layer is provided, the layer thickness will generally be of the order of 10 to 100 microns. The transition metal layer may also be provided by a foil of transition metal in which case the layer will be continuous. It is preferred that the layer be discontinuous. The metal foil, when provided, will also generally have a thickness of the order of 10 to 100 microns.

The transition metal will preferably be titanium.

The braze alloy may be any known braze alloy in the art which has the required melting point and the required ability to alloy with the transition metal. A wide variety of known braze alloys satisfy these requirements. A standard text book which describes suitable alloys is the Metals Handbook issued by the American Society for Metals, 8th edition, Volume 6, "Welding and Brazing", 1974. In particular, the preferred alloys are those which consist predominantly of one or more of the metals gold, silver and copper. It is also preferred that the alloys contain a minor amount of a metal such as cadmium or zinc, particularly zinc.

The braze alloy layer will generally be somewhat thicker than the transition metal layer. Typically, the braze alloy layer has a thickness in the range 0.05 to 0.5 mm. Particularly preferred thicknesses for the layer of braze alloy are in the range 0.1 to 0.2 mm.

Bonding is effected by exposing the unbonded assembly to a temperature in the range 650° to 750° C. The temperature will generally be raised rapidly to the required temperature and then maintained at this elevated value for a period of time sufficient to effect bonding. Generally, the rate at which the temperature is raised to the required elevated value is in the range 20° to 500° C. per minute. Once the elevated temperature has been reached, it is usually maintained for a period of about 2 to 180 minutes.

The heating, particularly where diamond compacts are concerned, will invariably take place in a non-oxidising atmosphere so that deterioration of the abrasive particles of the compact or compacts is minimised. As mentioned above, diamond is susceptible to graphitisation and this is the reason why, as a practical matter, a non-oxidising atmosphere is used. A non-oxidising atmosphere may be provided by an inert gas such as neon or argon or by a vacuum of $10^{-4}$ Torr or better.

For good bonding there should be intimate contact between the components of the unbonded assembly when heating takes place. The weight of the various components of the unbonded assembly may provide sufficient pressure to maintain intimate contact between the various components of the assembly. However, intimate contact can be ensured by clamping the first and second compacts together at a pressure of between 72.5 to 1450 lbs/sq. inch before heating.

The cemented carbide body may be any known in the art. The cemented carbide will generally be cemented tungsten carbide, cemented titanium carbide, cemented tantalum carbide or mixtures thereof. The bonding metal for the carbide may be any suitable in the art, typically nickel, cobalt or iron or mixtures thereof. The bonding metal is usually provided in a range of 3 to 35% by weight of the carbide. The preferred carbide is cemented tungsten carbide and the preferred bonding metal, particularly for cemented tungsten carbide, is cobalt. The invention is illustrated by the following non-limiting examples.

EXAMPLE 1

A diamond compact was bonded to a cemented carbide backing. The diamond compact consisted of a mass of diamond particles bonded into a hard conglomerate with a cobalt bonding matrix. The diamond particles constituted 80% by volume of the compact with the cobalt constituting the balance. The cemented carbide was cemented tungsten carbide.

The diamond compact was in the form of a segment of a circle. Fine titanium powder was sprinkled on one of the major flat surfaces of the compact to provide a discontinuous layer of titanium of thickness of approximately 70 microns. A commercially available braze, in foil form, consisting of 44% silver, 30% copper, and 26% zinc, all percentages being by weight of the alloy, was then placed on the titanium to provide a braze layer of thickness 0.1 mm. The cemented carbide support was then placed on the braze layer and the assembly was clamped together and placed in a vacuum of $10^{-5}$ Torr. The temperature was raised to 675° C., the melting point of the alloy, at a rate of approximately 200° per minute. The elevated temperature, once reached, was maintained for a period of 5 minutes.

This method resulted in very firm bonding between the compact and cemented carbide being achieved with no detectable graphitisation of the compact taking place.

EXAMPLE 2

In the similar manner to the Example 1 a diamond compact was bonded to a cemented tungsten carbide support. In this example the braze alloy consisted of 49% silver, 16% copper, 26% zinc, 4.5% nickel and 7.5% manganese, all percentages being by weight. The temperature was raised to 700° C. at a rate of approximately 200 degrees per minute. The non-oxidising atmosphere was again a vacuum of $10^{-5}$ Torr. The elevated temperature, once reached, was maintained for a period of 2 hours. Once again very firm bonding between the compact and the cemented carbide support was achieved. Subsequently by testing it was observed that the melting range of the braze layer was somewhat higher than 700° C.

I claim:

1. A method of bonding a diamond or cubic boron nitride abrasive compact to a second such compact or to a cemented carbide support including the steps of depositing a layer of a transition metal on the first compact in unbonded condition, depositing a layer of a braze alloy on the transition layer in unbonded condition, the braze alloy having a melting point in the range 650° C. to 750° C. and being capable of alloying with the transition metal, then, with the two layers unbonded to each other and the first compact, placing the second compact or carbide support on the braze layer; and heating the thus-formed unbonded assembly at a temperature between 650° C. and 750° C. for a period of 2 to 180 minutes with the first and second compacts clamped together at a pressure of between 72.5 and 1450 lbs/sq. inch to produce an alloy bonding layer bonding the first compact to the second compact or carbide support.

2. A method according to claim 1 wherein the transition metal is provided in powdered form.

3. A method according to claim 2 wherein the transition metal layer has a thickness in the range 10 to 100 microns.

4. A method according to claim 3 wherein the layer of braze alloy has a thickness in the range 0.05 to 0.5 mm.

5. A method according to claim 1 wherein the transition metal is titanium.

6. A method according to claim 1 wherein the layer of braze alloy has a thickness in the range 0.05 to 0.5 mm.

7. A method according to claim 1 wherein the layer of braze alloy has a thickness in the range 0.1 to 0.2 mm.

8. A method according to claim 1 wherein the alloy consists predominantly of one or more of the metals gold, copper and silver.

9. A method according to claim 8 wherein the alloy contains a minor amount of zinc or cadmium.

10. A method according to claim 1 wherein the first compact is a diamond compact.

11. A method according to claim 1 wherein the temperature is raised to the required value to effect bonding at a rate of 20 to 500° C. per minute.

12. A method according to claim 1 wherein the heating is effected in a non-oxidising atmosphere.

13. A method according to claim 12 wherein the non-oxidising atmosphere is provided by an inert gas or a vacuum of $10^{-4}$ Torr or better.

14. A method of bonding a diamond compact to a cemented carbide support including the steps of depositing a powdered transition metal layer of thickness 10 to 100 microns on the first compact in unbonded condition, depositing a layer of thickness 0.05 to 0.5 mm of a braze alloy on the transition layer in unbonded condition, the braze alloy consisting predominantly of one or more of the metals gold, silver and copper, having a melting point in the range 650° C. to 750° C. and being capable of alloying with the transition metal, then, with the to layers unbonded to each other and the first compact, placing the carbide support on the braze layer; and heating the thus-formed unbonded assembly to a temperature of 650° C. to 750° C. and maintaining the elevated temperature, once reached, for a period of 2 to 180 minutes with the first and second compacts clamped together at a pressure of between 72.5 and 1450 lbs/sq. inch to produce an alloy bonding layer bonding the first compact to the carbide support.

15. A method according to claim 14 wherein the transition metal is titanium.

16. A method according to claim 15 wherein the temperature is raised to the required value to effect bonding at a rate of 20° to 500° C. per minute.

* * * * *